US011253862B1

(12) United States Patent
Zano et al.

(10) Patent No.: US 11,253,862 B1
(45) Date of Patent: Feb. 22, 2022

(54) TEST TUBE WITH AN INTERNAL MEMBER AND TEST TUBE WITH A NARROWED REGION AT ITS CLOSED END

(71) Applicants: AID GENOMICS LTD, Rehovot (IL); Danyel Biotech Ltd, Ness Ziona (IL)

(72) Inventors: Snir Zano, Omer (IL); Daniel Gurevich, Mazceret Batiya (IL)

(73) Assignees: AID GENOMICS LTD, Rehovot (IL); DANYEL BIOTECH LTD, Ness Ziona (IL)

( * ) Notice: Subject to any disclaimer, the term of this patent is extended or adjusted under 35 U.S.C. 154(b) by 0 days.

(21) Appl. No.: 17/229,887

(22) Filed: Apr. 14, 2021

Related U.S. Application Data

(63) Continuation-in-part of application No. 17/099,843, filed on Nov. 17, 2020, now Pat. No. 11,135,591.

(51) Int. Cl.
*B01L 3/00* (2006.01)

(52) U.S. Cl.
CPC ..... *B01L 3/5082* (2013.01); *B01L 2300/0832* (2013.01)

(58) Field of Classification Search
CPC .... B01L 3/5029; B01L 3/5082; B01L 3/5085; B01L 2300/0832; B01L 2300/0851; B01L 2300/0858; B01L 3/5021
See application file for complete search history.

(56) References Cited

U.S. PATENT DOCUMENTS

| | | | | |
|---|---|---|---|---|
| 4,197,287 | A | 4/1980 | Piasio | |
| 4,427,634 | A * | 1/1984 | Truglio | G02B 21/34 356/246 |
| 4,720,374 | A | 1/1988 | Ramachandran | |
| 4,830,217 | A | 5/1989 | Dufresne | |
| 5,030,421 | A * | 7/1991 | Muller | G02B 21/34 422/549 |
| 5,260,032 | A * | 11/1993 | Muller | B01L 3/5021 356/244 |
| 5,853,600 | A | 12/1998 | McNeal | |
| 6,254,834 | B1 * | 7/2001 | Anderson | B01L 3/5021 422/548 |
| 2005/0277188 | A1 | 12/2005 | Ellis | |
| 2009/0030342 | A1 | 1/2009 | Flanigan | |
| 2009/0258411 | A1 | 10/2009 | Petithory | |
| 2010/0274155 | A1 * | 10/2010 | Battrell | B01L 3/502715 600/572 |

* cited by examiner

*Primary Examiner* — Jill A Warden
*Assistant Examiner* — Dwayne K Handy
(74) *Attorney, Agent, or Firm* — Pearl Cohen Zedek Latzer Baratz LLP

(57) ABSTRACT

A test tube may include: an annular body having an open first end, a closed second end, a longitudinal surface extending between the open first end and the closed second end and enveloping a hollow interior of the annular body and a central longitudinal axis; wherein the longitudinal surface of the annular body may include: a first longitudinal portion that may include the open first end of the annular body and having a substantially circular cross-section; and a second longitudinal portion that may include: a first longitudinal side having a substantially circular-arc cross-section; and a second longitudinal side tapering in a longitudinal direction of the annular body towards the closed second end of the annular body.

16 Claims, 8 Drawing Sheets

TEST TUBE WITH AN INTERNAL MEMBER AND TEST TUBE WITH A NARROWED REGION AT ITS CLOSED END

CROSS REFERENCE TO RELATED APPLICATIONS

This application is a continuation in part of U.S. patent application Ser. No. 17/099,843 filed on Nov. 17, 2020 and entitled "TEST TUBE WITH AN INTERNAL MEMBER", which is incorporated herein by reference in its entirety.

FIELD OF THE INVENTION

The present invention relates to the field of laboratory equipment and, more particularly, to test tubes.

BACKGROUND OF THE INVENTION

Some biological tests may require obtaining a sample of a biological material from a subject using a test stick, such as swab stick. After the sample is obtained, the test stick is typically positioned into a test tube that may be filled, or prefilled, with a buffer solution. The test stick is typically free to move within the test tube such that the position of the test stick in the test tube may be random and may vary during transportation of the test tube. The test tube, with the test stick and the buffer solution, is typically transported to a facility where the buffer solution is analyzed to obtain a test result.

An automatic liquid handling system may analyze the content of multiple test tubes simultaneously. The automatic liquid handling system typically intakes the buffer solution from the test tubes using a pipette array. Any contact of the pipettes with the test stick may be harmful for the automatic liquid handling system. Since the position of the test sticks within a typical test tube is random, such typical test tubes with the test sticks positioned therein cannot be used in the automatic liquid handling system, as the system cannot be preset to avoid contact of the pipettes with the test sticks. Accordingly, the buffer solution is typically manually transferred from the test tubes to secondary test tubes, and the secondary test tubes are then inserted into the automatic liquid handling system for further analysis of the buffer solution.

However, transfer of the buffer solution from the test tubes to the secondary test tubes may be time consuming, especially when handling large amounts of test tubes. Moreover, transfer of the buffer solution from the test tubes to the secondary test tubes may lead to accidents. For example, the buffer solution may be spilled during the transfer. Furthermore, transfer of the buffer solution from the test tubes to the secondary test tubes may expose a laboratory assistant handling the buffer solution transfer to potential hazard. For example, the buffer solution may contain bio-hazard materials, and/or the obtained samples may be infected and/or may contain bacteria, viruses, etc.

SUMMARY OF THE INVENTION

Some embodiments of the present invention provide a test tube including an annular body having an open proximal end and a closed distal end, and a longitudinal member in a distal portion of an interior the annular body, wherein the longitudinal member is substantially parallel to a central longitudinal axis of the annular body and is connected to at least one internal surface of the distal portion of the annular body.

In some embodiments, the longitudinal member is formed as an integral part of the at least one internal surface of the annular body.

In some embodiments, the longitudinal member is substantially flat.

In some embodiments, the longitudinal member is connected at its distal end to the distal end of the annular body and extends proximally into the interior of the annular body.

In some embodiments, the longitudinal member is connected at at least one of its longitudinal lateral surfaces to an internal lateral surface of the annular body and extends inwardly into the interior of the annular body.

In some embodiments, the longitudinal member is positioned within a region extending between the distal end and a middle of the annular body along the central longitudinal axis of the annular body.

In some embodiments, the longitudinal member is offset in a radial direction with respect to the central longitudinal axis of the annular body.

In some embodiments, the test tube includes a gap between the longitudinal member and the at least one internal surface of the annular body.

In some embodiments, the longitudinal member includes two opposite flat longitudinal portions and a gap therebetween.

In some embodiments, each of the flat longitudinal portions tapers in a longitudinal direction extending between the distal end and the proximal end of the annular body.

In some embodiments, a radial distance between the longitudinal member and an internal lateral surface of the annular body is preset so as to tightly receive a testing portion of a test stick in a region between the longitudinal member and the internal lateral surface of the annular body.

In some embodiments, the test tube includes a marking indicative of a position of the region within the interior of the annular body.

In some embodiments, the marking is on an external lateral surface of the annular body.

In some embodiments, the test tube includes a marking indicating an identification label position, which is a position at which the identification label may be attached.

In some embodiments, the marking is on an external lateral surface of the annular body.

In some embodiments, the test tube includes a thread on an external lateral surface of the annular body adjacent to the proximal end thereof, wherein the thread mates with a thread on an internal lateral surface of a test tube cap.

In some embodiments, the test tube includes protrusions on an external lateral surface of the annular body adjacent to the proximal end thereof, wherein the protrusions mate with grooves on an internal lateral surface of a test tube cap.

Some embodiments of the present invention provide a kit including the test tube described hereinabove and a test tube cap structured to tightly close the proximal end of the test tube.

Some embodiments of the present invention provide a kit including the test tube described hereinabove, and one or more test sticks.

In some embodiments, each of the test sticks comprises a weakened portion along the test stick.

Some embodiments of the present invention may provide a test tube that may include: an annular body having a first or proximal end that is open, a second or distal end that is closed, a longitudinal surface extending between the first open end and the second closed end and enveloping a hollow interior of the annular body, and a central longitudinal axis; wherein the longitudinal surface of the annular body may include: a first longitudinal portion comprising the open first or proximal end of the annular body and having a substantially circular cross-section; and a second longitudinal portion that may include: a first longitudinal side having a substantially circular-arc cross-section; and a second longitudinal side tapering in a longitudinal direction of the annular body towards the second closed end of the annular body.

In some embodiments, the second longitudinal side of the second longitudinal portion of the longitudinal surface is curved inwardly towards the interior of the annular body, wherein a slope of the inwardly curved second longitudinal side varies along at least a portion of its length.

In some embodiments, the second longitudinal side of the second longitudinal portion of the longitudinal surface comprises one or more substantially planar regions, each having a constant slope.

In some embodiments, the second longitudinal side of the second longitudinal portion of the longitudinal surface may include one or more substantially planar regions each having a constant slope and one or more inwardly curved regions curved towards the interior of the annular body.

In some embodiments, the second longitudinal side of the second longitudinal portion of the longitudinal surface may include a distal planar region that is connected to the second closed end of the annular body and extends in a direction that is substantially parallel to the central longitudinal axis of the annular body.

In some embodiments, the distal planar region of the second longitudinal side of the second longitudinal portion of the longitudinal surface is offset with respect to the central longitudinal axis of the annular body towards the first longitudinal side of the second longitudinal portion of the longitudinal surface.

In some embodiments, the second longitudinal side of the second longitudinal portion of the longitudinal surface forms a narrowed region within the interior of the annular body adjacent to the second closed end of the annular body.

In some embodiments, the second longitudinal side of the second longitudinal portion of the longitudinal surface is shaped and sized such that the narrowed region tightly receives one or more testing portions of corresponding one or more test sticks.

In some embodiments, the test tube may further include a second annular body surrounding the second longitudinal portion of the longitudinal surface of the annular body.

In some embodiments, the second annular body is connected at its first or proximal end to a second or distal end of the first longitudinal portion of the longitudinal surface of the annular body.

In some embodiments, the second annular body is formed as an integral part of the annular body.

Some embodiments of the present invention may provide a kit that may include: the test tube described hereinabove; and a test tube cap structured to tightly close the open end of the test tube.

Some embodiments of the present invention may provide a kit that may include: the test tube described hereinabove; and one or more test sticks.

In some embodiments, each of the test sticks comprises a weakened portion along the test stick.

These, additional, and/or other aspects and/or advantages of the present invention are set forth in the detailed description which follows; possibly inferable from the detailed description; and/or learnable by practice of the present invention.

BRIEF DESCRIPTION OF THE DRAWINGS

For a better understanding of embodiments of the invention and to show how the same can be carried into effect, reference will now be made, purely by way of example, to the accompanying drawings in which like numerals designate corresponding elements or sections throughout.

In the accompanying drawings.

Figure 1B:
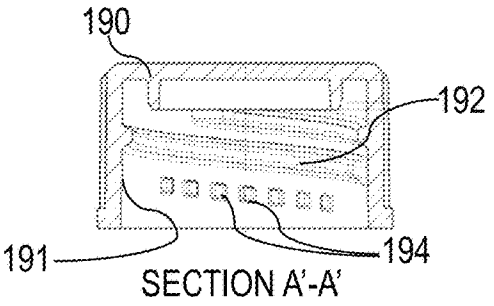
FIG. 1B is a schematic illustration of a section A-A of a cap for a test tube, according to some embodiments of the invention.

It will be appreciated that, for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following description, various aspects of the present invention are described. For purposes of explanation, specific configurations and details are set forth in order to provide a thorough understanding of the present invention. However, it will also be apparent to one skilled in the art that the present invention can be practiced without the specific details presented herein. Furthermore, well known features can have been omitted or simplified in order not to obscure the present invention. With specific reference to the drawings, it is stressed that the particulars shown are by way of example and for purposes of illustrative discussion of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention can be embodied in practice.

Before at least one embodiment of the invention is explained in detail, it is to be understood that the invention is not limited in its application to the details of construction and the arrangement of the components set forth in the following description or illustrated in the drawings. The invention is applicable to other embodiments that can be practiced or carried out in various ways as well as to combinations of the disclosed embodiments. Also, it is to be understood that the phraseology and terminology employed herein is for the purpose of description and should not be regarded as limiting.

Figure 1C:
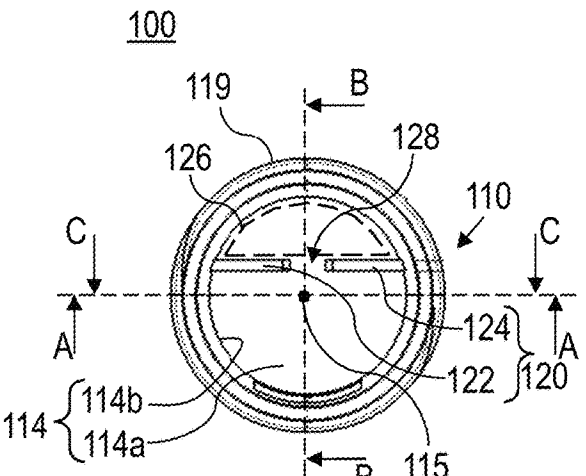
FIGS. 1C, 1D, 1E, 1F and 1G are schematic illustrations of different views of a test tube, according to some embodiments of the invention.
Figure 1A:
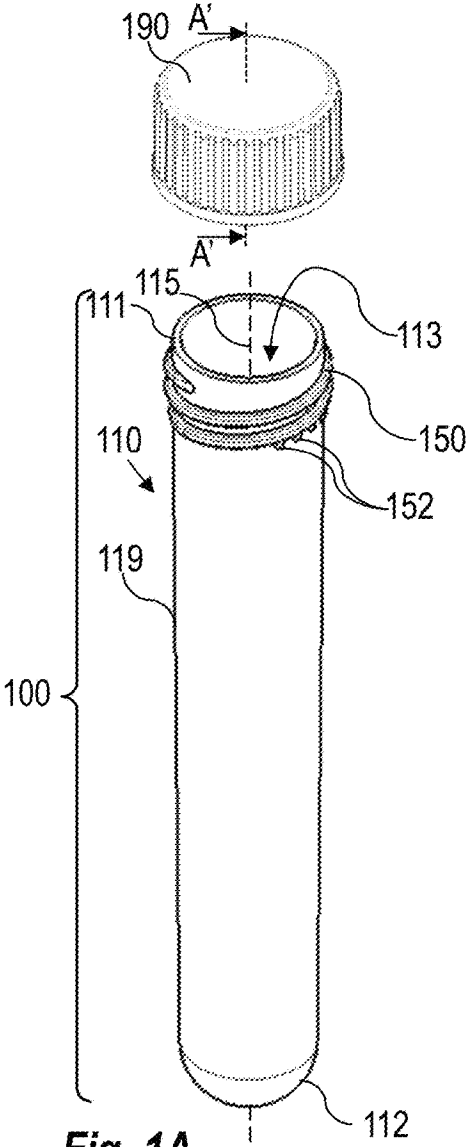
FIG. 1A is a schematic illustration of a test tube and of a cap for the test tube, according to some embodiments of the invention.

Reference is now made to FIG. 1A, which is a schematic illustration of a test tube 100 and of a cap 190 for test tube 100, according to some embodiments of the invention. FIG. 1A shows a schematic perspective view of test tube 100 and of cap 190.

Reference is also made to FIG. 1B, which is a schematic illustration of a section A'-A' view of a cap 190 for a test tube 100, according to some embodiments of the invention.

Figure 1D:
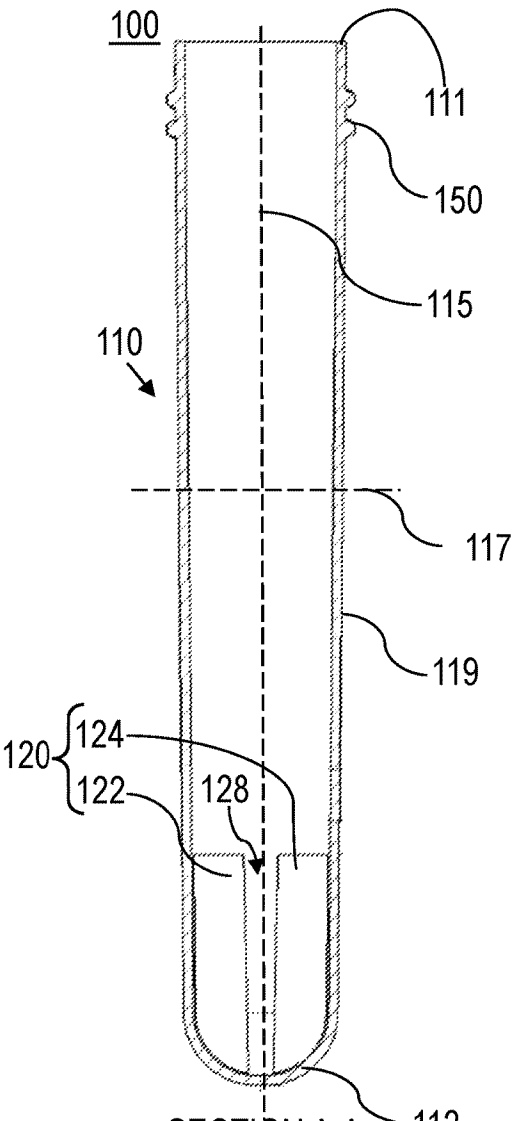
Figure 1E:
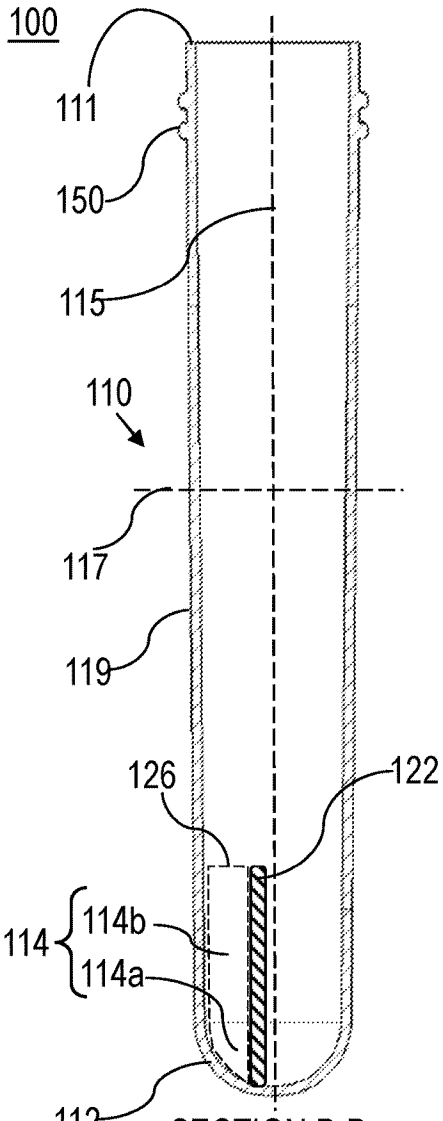
Figure 1G:
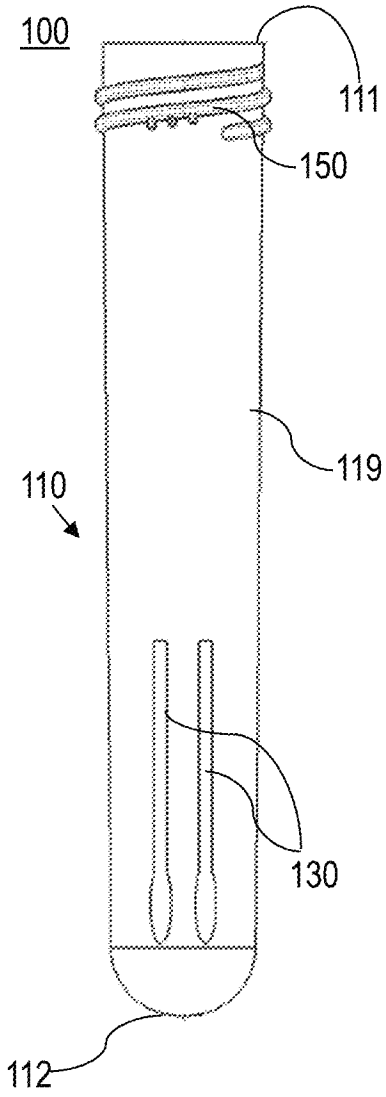
Figure 1F:
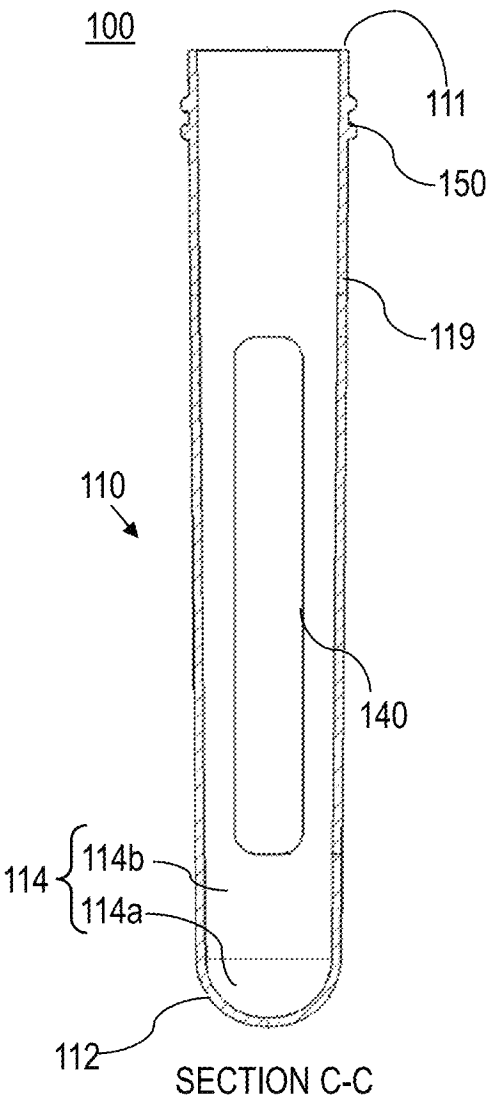
Figures 2A, 2B, 2C, 2D:
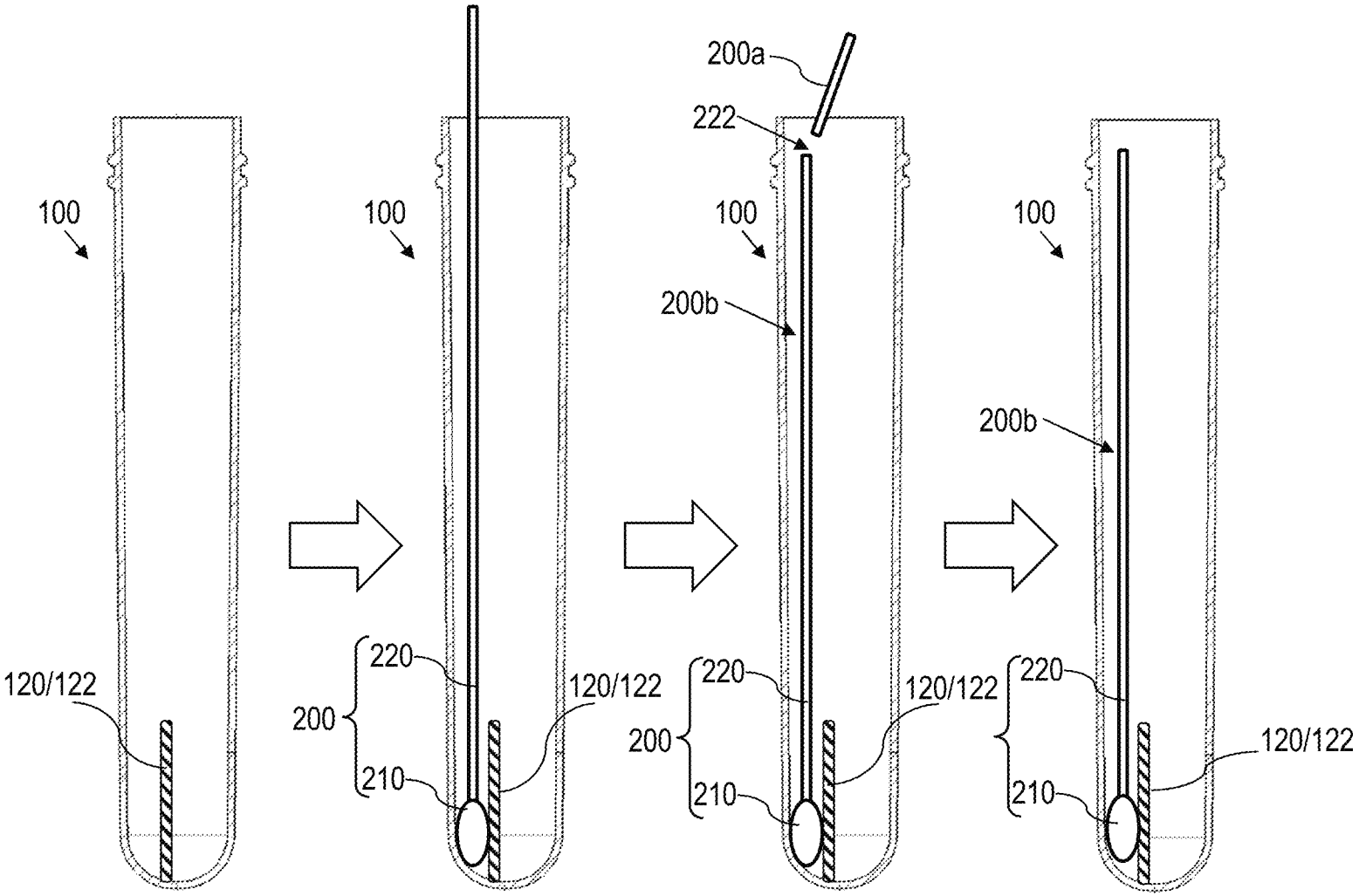
FIGS. 2A, 2B, 2C and 2D are schematic illustrations of a process of handling a test stick and a test tube, according to some embodiments of the invention.

Reference is also made to FIGS. 1C, 1D, 1E, 1F and 1G, which are schematic illustrations of different views of test tube 100, according to some embodiments of the invention. FIG. 1C shows a schematic top view of test tube 100. FIGS. 1D, 1E and 1F show schematic section A-A view, section B-B view and section C-C view of test tube 100, respectively. FIG. 1G shows a schematic side view of test tube 100.

Test tube 100 may include an annular body 110 having an open proximal end 111 and a closed distal end 112. According to some embodiments of the invention, test tube 100 includes a longitudinal member 120 within an interior 113 of annular body 110. In some embodiments, longitudinal member 120 is formed as an integral part of an internal surface 114 of annular body 110. In some embodiments, longitudinal member is flat or substantially flat. In some embodiments, longitudinal member 120 is connected to at least one internal surface 114 of annular body 110. In some embodiments, longitudinal member 120 is parallel, or substantially parallel, to a central longitudinal axis 115 of annular body 110.

In some embodiments, longitudinal member 120 is connected at its distal end to an internal surface 114*a* of distal end 112 of annular body 110 and extends proximally into interior 113 of annular body 110. In some embodiments, longitudinal member 120 is connected at its longitudinal lateral surface to an internal lateral surface 114*b* of annular body 110 and extends inwardly into interior 113 of annular body 110.

In some embodiments, longitudinal member 120 is positioned within a region extending between distal end 112 and a middle 117 of annular body 110 along central longitudinal axis 115 of annular body 110. In some embodiments, longitudinal member 120 is offset in a radial direction with respect to central longitudinal axis 115 of annular body 110.

In some embodiments, a radial distance between longitudinal member 120 and internal lateral surface 114*b* of annular body 110 is preset so that a testing portion of a test stick (e.g., a swab of the test stick) is tightly receivable within a region 126 between longitudinal member 120 and internal lateral surface 114*b* of annular body 110.

In various embodiments, test tube 100 includes a gap 128 between longitudinal member 120 and at least one internal surface 114 of annular body 110 or between two portions of longitudinal member 120. When annular body 110 of test tube 100 is filled with a buffer solution, the buffer solution may freely flow through gap 128.

In some embodiments, longitudinal member 120 includes two opposite flat longitudinal portions 122, 124 and gap 128 therebetween (e.g., as shown in FIGS. 1C and 1D). In some embodiments, each of flat longitudinal portions 122, 124 tapers in a longitudinal direction extending between distal end 112 and proximal end 111 of annular body 110 (e.g., as shown in FIGS. 1C and 1D).

In some embodiments, gap 128 is between longitudinal member 120 and internal surface 114*a* of distal end 112 of annular body 120. In some embodiments, gap 128 is between longitudinal member 120 and internal lateral surface 114*b* of annular body 110.

In some embodiments, a length of longitudinal member 120 is 15-25% of a length of annular body 110. In some embodiments, a width of longitudinal member 120 is 75-85% of a diameter of annular body 110. In some embodiments, a width of gap 128 is 15-25% of the diameter of annular body 110. In some embodiments, a width of each of flat longitudinal member portions 122, 124 is 35-45% of the diameter of annular body 110. In some embodiments, longitudinal member 120 is offset with respect to central longitudinal axis 115 of annular body 110 by a radial distance of 2-8% of the diameter of annular body 110.

It is noted that FIGS. 1C, 1D and 1E show one embodiment of longitudinal member 120 and that other embodiments of longitudinal member 120 are also possible.

Longitudinal member 120 may form region 126 within interior 113 of annular body 110, between longitudinal member 120 and internal lateral surface 114*b* of annular body 110, that may tightly receive the testing portion of one or more test sticks. In some embodiments, test tube 100 includes a marking 130 indicative of a position of region 126 within interior 113 of annular body 110 (e.g., as shown in FIG. 1G). In some embodiments, marking 130 is on a portion of on an external lateral surface 119 of annular body 110 that forms region 126. For example, marking 130 may include an image of one or more test sticks.

In some embodiments, test tube 100 includes a marking 140 indicating an identification label position, which is a position at which the identification label (e.g., a barcode label) may be attached (e.g., as shown in FIG. 1F). In some embodiments, marking 140 is on external lateral surface 119 of annular body 110. For example, marking 140 may be opposite to region 126. Since the position of marking 140 with respect to region 126 is known, marking 140 may be indicative of a position of region 126 within interior 113 of annular body 110.

In some embodiments, test tube 100 includes a thread 150 on external lateral surface 119 of annular body 110 adjacent to proximal end 111 thereof, wherein thread 150 mates with a thread 192 on internal lateral surface 191 of cap 190. Cap 190 may be screwed onto proximal end 111 of annular body 110 so as to tightly close proximal end 111 of annular body 110 of test tube 100.

In some embodiments, test tube 100 includes protrusions 152 on external lateral surface 119 of annular body 110 adjacent to proximal end 111 thereof, and cap 190 includes grooves 194 on its internal lateral surface 191, wherein grooves 194 are configured to mate with protrusions 152. When cap 190 is screwed onto proximal end 111 of annular body 110, protrusions 152 may enter into grooves 194 so as secure cap 190 to annular body 110 and to prevent unintended unscrewing of cap 190 from annular body 110.

Reference is now made to FIGS. 2A, 2B, 2C and 2D, which are schematic illustrations of a process of handling a test stick 200 and a test tube 100, according to some embodiments of the invention.

When test stick 200 is inserted into interior 113 of annular body 110 of test tube 100, a testing portion 210 (e.g., a swab) of a test stick 200 may be tightly received between longitudinal member 120 and internal lateral surface 114*b* of annular body 110 of test tube 100. An elongated portion 220 of test stick 200 may be broken, for example at a breaking point 222, so that only a distal portion 200*b* of test stick 200 remains within interior 113 of annular body 110 of test tube 100, with testing portion 210 thereof being tightly received between longitudinal member 120 and internal lateral surface 114*b* of annular body 110. A proximal portion 200*a* of test stick 200 may be removed away from interior 113 annular body 110 of test tube 100.

In some embodiments, two or more test sticks 200 may be inserted into interior 113 of annular body 110 of test tube 100, and testing portions 210 of two or more test sticks 200 may be tightly received between longitudinal member 120 and internal lateral surface 114*b* of annular body 110 of test tube 100.

Since the position of longitudinal member 120 within interior 113 of annular body 110 of test tube 110 is known, the position of distal portion 200*b* of test stick 200 tightly received between longitudinal member 120 and internal lateral surface 114*b* of annular body 110 is known as well. Accordingly, test tube 100 with distal portion 200*b* of test stick 200 may be inserted into an automatic liquid handling system as the automatic liquid handling system may be preset to avoid the contact of the pipettes thereof with distal portion 200*b* of test stick 200 in test tube 100. Test tube 100 with longitudinal member 120 may, for example, eliminate a need in transferring the buffer solution from the test tube to a secondary tube as is typically done when using typical test tubes that have no longitudinal member. This may, for example, save significant time (e.g., especially when handling large amounts of test tubes), prevent accidents and enhance safety of laboratory staff handling the test tubes, as compared to when typical test tubes that have no longitudinal member are being used.

Some biological tests, such as a test for COVID-19 disease, may require collecting biological samples from two different locations of a subject (e.g., from a nose and a throat) using two different test sticks. Usually, these test sticks are inserted into two different test tubes and analyzed separately. According to some embodiments of the present invention, a single test tube 100 may accommodate distal portions 200*b* of two or more test sticks 200. This may, for example, significantly reduce a number of test tubes and an amount of testing materials (e.g., such as buffer solution, etc.) needed to perform the test, especially when performing large number of tests. Furthermore, this may prevent identification mistakes that may occur when using two separate test tubes for the same subject.

Figure 3:
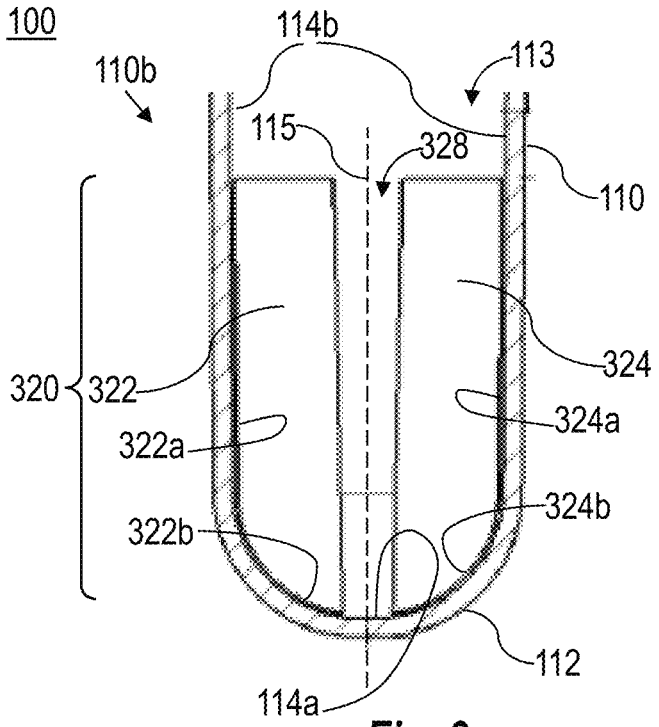
FIGS. 3, 4 and 5 are schematic illustrations of a test tube having different configurations of an internal longitudinal member, according to some embodiments of the invention.
Figure 4:
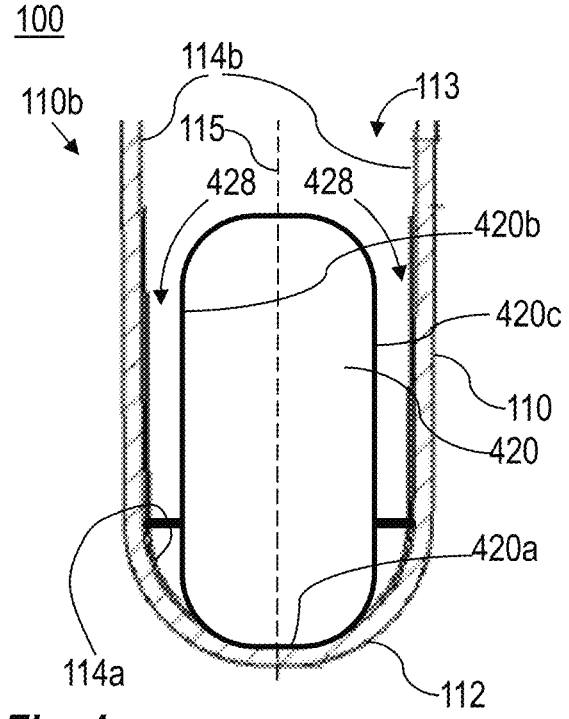
Figure 5:
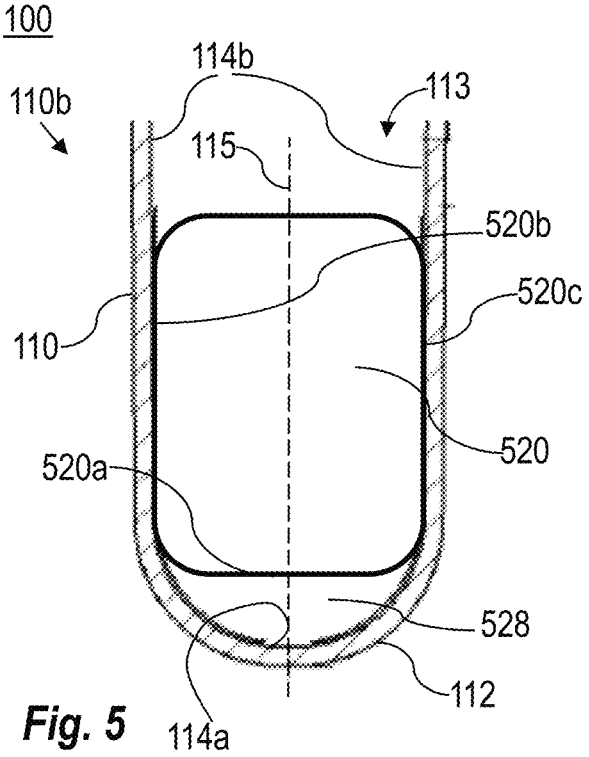

Reference is now made to FIGS. 3, 4 and 5, which are schematic illustrations of a test tube 100 having different configurations of an internal longitudinal member, according to some embodiments of the invention. FIGS. 3, 4, and 5 show a schematic section A-A view of a distal portion 110*b* of annular body 110 of test tube 100 (e.g., section A-A as defined in FIG. 1C).

FIG. 3 schematically shows distal portion 110*b* of annular body 110 test tube 100 having longitudinal member 320. Longitudinal member 320 may be similar to longitudinal member 120 described hereinabove. Longitudinal member 320 may include two opposite flat longitudinal portions 322, 324 having a gap 328 therebetween. Each of flat longitudinal portions 322, 324 may be connected at one of its longitudinal lateral surfaces 322*a*, 324*a*, respectively, to internal lateral surface 114*b* of annular body 110 and extend internally into interior 113 of annular body 110. Each of flat longitudinal portions 322, 324 may be connected at its distal end 322*b*, 324*b*, respectively, to internal surface 114*a* of distal end 112 of annular body 110 and extend longitudinally into interior 113 of annular body 110. In some embodiments, each of flat longitudinal portions 322, 324 tapers in a longitudinal direction extending between distal end 112 and proximal end 111 of annular body 110 of test tube 100.

FIG. 4 schematically shows test tube 100 having longitudinal member 420. Longitudinal member 420 may be connected at its distal end 420*a* to internal surface 114*a* of distal end 112 of annular body 110 and extend longitudinally into interior 113 of annular body 110. Test tube 100 may include two gaps 428 each between one of opposite longitudinal lateral surface 420*b*, 420*c* of longitudinal member 420 and internal lateral surface 114*b* of annular body 110 of test tube 100.

In some embodiments, longitudinal member 420 is formed as an integral part of internal surface 114 of annular body 110. In some embodiments, longitudinal member 420 is flat or substantially flat. In some embodiments, longitudinal member 420 is parallel, or substantially parallel, to a central longitudinal axis 115 of annular body 110. In some embodiments, longitudinal member 420 is positioned within a region extending between distal end 112 and a middle 117 of annular body 110 along central longitudinal axis 115 of annular body 110. In some embodiments, longitudinal member 420 is offset in a radial direction with respect to central longitudinal axis 115 of annular body 110.

In some embodiments, a length of longitudinal member 420 is 15-25% of a length of annular body 110. In some embodiments, a width of longitudinal member 420 is 75-85% of a diameter of annular body 110. In some embodiments, longitudinal member 420 is offset with respect to central longitudinal axis 115 of annular body 110 by a radial distance of 2-8% of the diameter of annular body 110.

FIG. 5 schematically shows test tube 100 having longitudinal member 520. Longitudinal member 520 may be flat or substantially flat. Longitudinal member 520 may be connected at its opposite lateral longitudinal surfaces 520*b*, 520*c* to internal lateral surface 114*b* of annular body 110 of test tube 100. Test tube 100 may a gap 528 between a distal end 520*a* of longitudinal member 520 and internal surface 114*a* of distal end 112 of annular body 110 of test tube 100.

In some embodiments, longitudinal member 520 is formed as an integral part of an internal surface 114 of annular body 110. In some embodiments, longitudinal member 520 is flat or substantially flat. In some embodiments, longitudinal member 520 is parallel, or substantially parallel, to a central longitudinal axis 115 of annular body 110. In some embodiments, longitudinal member 520 is positioned within a region extending between distal end 112 and a middle 117 of annular body 110 along central longitudinal axis 115 of annular body 110. In some embodiments, longitudinal member 520 is offset in a radial direction with respect to central longitudinal axis 115 of annular body 110. In some embodiments, a length of longitudinal member 520 is 15-25% of a length of annular body 110. In some embodiments, longitudinal member 520 is offset with respect to central longitudinal axis 115 of annular body 110 by a radial distance of 2-8% of the diameter of annular body 110.

Some embodiments of the present invention provide a kit including test tube 100 and cap 190. In some embodiments, the kit includes one or more test sticks 200. In some embodiments, each of one or more test sticks 200 includes a weakened portion so as to enhance breaking of test stick 200 as described hereinabove.

Some embodiments of the present invention provide a kit including test tube 100 and one or more test sticks 200. In some embodiments, each of one or more test sticks 200 includes a weakened portion so as to enhance breaking of test stick 200 as described hereinabove. In some embodiments, the kit includes cap 190.

Figure 6A:
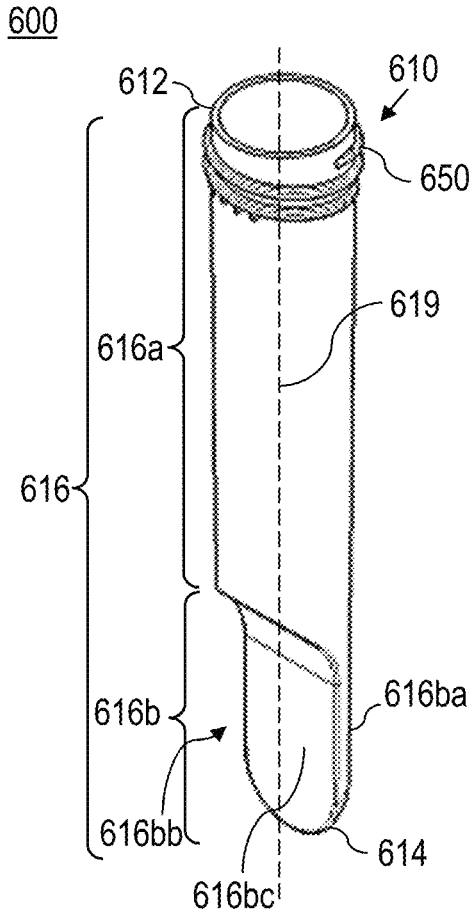
FIGS. 6A and 6B are schematic illustrations of a test tube including a narrowed region at its closed end, according to some embodiments of the invention.
Figure 6B:
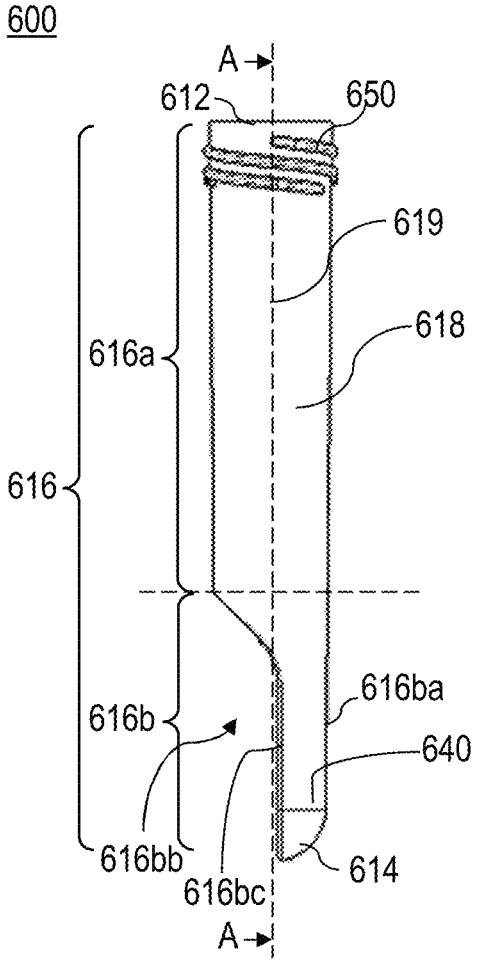

Reference is now made to FIGS. 6A and 6B, which are schematic illustrations of a test tube 600 including a narrowed region 640 at its closed end 614, according to some embodiments of the invention.

Figure 6C:
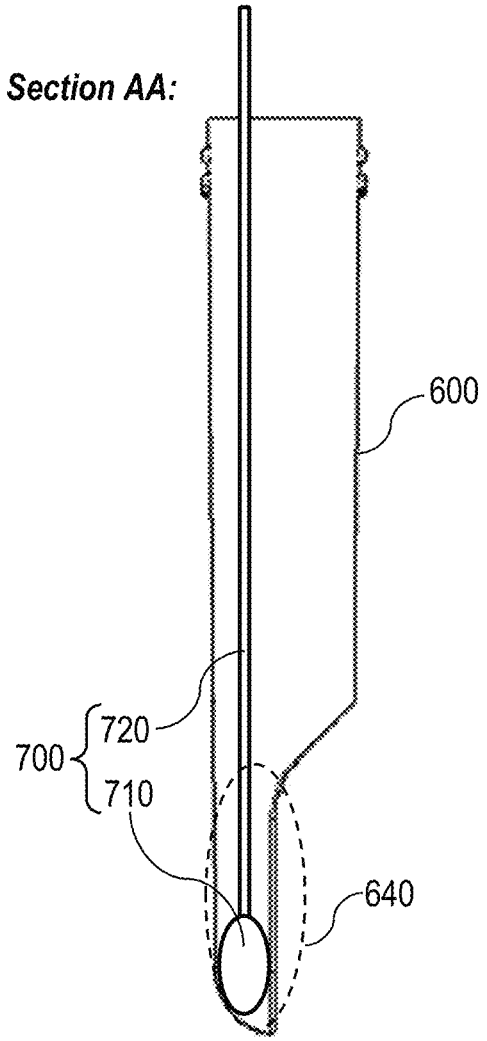
FIG. 6C is a schematic illustration of a test tube including a narrowed region at its closed end, and of a test stick, according to some embodiments of the invention.

Reference is also made to FIG. 6C, which is a schematic illustration of a test tube 600 including a narrowed region 640 at its closed end 614, and of a test stick 700, according to some embodiments of the invention.

FIG. 6A shows a schematic panoramic view of test tube 600. FIG. 6B shows a schematic side view of test tube 600. FIG. 6C shows a schematic longitudinal section view A-A (defined in FIG. 6B) of test tube 600.

Test tube 600 may include an annular, substantially cylindrical body 610 having an open first or proximal end 612, a closed second or distal end 614, and a longitudinal surface 616 extending between first open end 612 and second closed end 614 of annular body 610 and enveloping a hollow interior 618 of annular body 610. In some embodiments, longitudinal surface 616 is generally or substantially cylindrical. In some embodiments, closed second end 614 has a rounded, hemi-spherical dome shape.

Longitudinal surface 616 may include a proximal, first longitudinal portion 616*a* including open first end 612 of annular body 610, and a distal, second longitudinal portion 616*b* including closed second end 614 of annular body 610.

First longitudinal portion 616*a* of longitudinal surface 616 may have a generally or substantially cylindrical shape with a circular (or substantially circular) cross-section. Second longitudinal portion 616*b* of longitudinal surface 616 may include a first longitudinal side 616*ba* and a second longitudinal side 616*bb*. First longitudinal side 616*ba* of second longitudinal portion 616*b* of longitudinal surface 616 may have a generally or substantially semi-cylindrical shape with a circular-arc (or substantially circular-arc) cross-section. Second longitudinal side 616*bb* of second longitudinal portion 616*b* of longitudinal surface 616 may taper in a direction that is parallel to a central longitudinal axis 619 of annular body 610 towards closed second end 614 of annular body 616.

In some embodiments, the tapered second longitudinal side 616*bb* of second longitudinal portion 616*b* of longitudinal surface 616 may be curved inwardly towards interior 618 of annular body 610. The slope of the inwardly curved second longitudinal side 616*bb* of second longitudinal portion 616*b* of longitudinal surface 616 may vary along at least a portion of its length.

In some embodiments, tapered second longitudinal side 616*bb* of second longitudinal portion 616*b* of longitudinal surface 616 may include one or more planar regions (or substantially planar regions), wherein each of the one or more planar regions may have a constant slope.

In some embodiments, tapered second longitudinal side 616*bb* of second longitudinal portion 616*b* of longitudinal surface 616 may include one or more planar regions (or substantially planar regions) and one or more inwardly curved regions that are curved inwardly towards interior 618 of annular body 610.

In some embodiments, the tapered second longitudinal side 616*bb* of second longitudinal portion 616*b* of longitudinal surface 616 may include a distal planar region 616*bc* that is connected to second closed end 614 of annular body 610 and extends in a direction that is parallel (or substantially parallel) to a central longitudinal direction 619 of annular body 610. In some embodiments, distal planar region 616*bc* may be offset from central longitudinal axis 619 of annular body 610 towards first longitudinal side 616*ba* of second longitudinal portion 616*b* of longitudinal surface 616 of annular body 616.

In some embodiments, a length of second longitudinal portion 616*b* of longitudinal surface 616 of annular body 610 may range between 20-40% of a total length of longitudinal surface 616 of annular body 610. In some embodiments, a length of distal planar region 616*bc* of second longitudinal portion 616*b* of longitudinal surface 616 of annular body 610 may be at least 40% of the length of second longitudinal portion 616*b* of longitudinal surface 616 of annular body 610. In some embodiments, the offset of distal planar region 616*bc* from central longitudinal axis 619 of annular body 610 towards first longitudinal side 616*ba* of second longitudinal portion 616*b* of longitudinal surface 616 of annular body 610 may range between 5-10% of a maximal diameter of annular body 610.

In some embodiments, closed second end 614 of annular body 610 may be rounded with respect to first longitudinal side 616*ba* of second longitudinal portion 616*b* of longitudinal surface 616 of annular body 610. For example, second closed end 614 may have a shape of a portion of a spherical dome.

The tapered second longitudinal side 616*bb* of second longitudinal portion 616*b* of longitudinal surface 616 may form, with first longitudinal side 616*ba* of second longitudinal portion 616*b* of longitudinal surface 616, a narrowed region 640 within interior 618 of annular body 610 adjacent to closed second end 614 of annular body 610. The tapered second longitudinal side 616*bb* of second longitudinal portion 616*b* of longitudinal surface 616 may be shaped and sized such that narrowed region 640 may tightly receive a testing portion (e.g., a swab) of a test stick (e.g., such as testing portion 210 of test stick 200 described above with respect to FIGS. 2A-2D). In some embodiments, tapered second longitudinal side 616*bb* of second longitudinal portion 616*b* of longitudinal surface 616 may be shaped and sized such that narrowed region 640 may tightly receive testing portions of two or more test sticks. For example, FIG. 6C schematically shows a testing portion 710 of a test stick 700 tightly received within narrowed region 640. An elongated portion 720 of test stick 700 may be further broken such that the entire test stick 700 may be fully accommodated within test tube 600 (e.g., as described above with respect to FIGS. 2A-2D).

Since the position of narrowed region 640 within interior 618 of annular body 610 of test tube 600 is known, the position of distal portion(s) including the testing portion(s) of the test stick(s) tightly received within narrowed region 640 is known as well (e.g., as shown in FIG. 6C and as described above with respect to FIGS. 2A-2D). Accordingly, test tube 600 with the distal portion(s) of the test stick(s) may be inserted into an automatic liquid handling system, as the automatic liquid handling system may be preset to avoid the contact of the pipettes thereof with the distal portion(s) of the test stick(s) in test tube 600 (e.g., as described above with respect to FIGS. 2A-2D). Use of test tube 600 having narrowed region 640 may, for example, eliminate a need in transferring the buffer solution from the test tube to a secondary tube as is typically done when using typical test tubes that have no longitudinal member (e.g., as described above with respect to FIGS. 2A-2D). This may, for example, save significant time (e.g., especially when handling large amounts of test tubes), prevent accidents and enhance safety of laboratory staff handling the test tubes, as compared to when typical test tubes that have no longitudinal member are being used (e.g., as described above with respect to FIGS. 2A-2D).

Some biological tests, such as a test for COVID-19 disease, may require collecting biological samples from two different locations of a subject (e.g., from a nose and a throat) using two different test sticks. Usually, these test sticks are inserted into two different test tubes and analyzed separately. According to some embodiments of the present invention, a single test tube 600 may accommodate the distal portions of two or more test sticks. This may, for example, significantly reduce the number of test tubes and an amount of testing materials (e.g., such as buffer solution, etc.) that are needed to perform the test, especially when performing a large number of tests. Furthermore, this may prevent identification mistakes that may occur when using two separate test tubes for the same subject.

Figure 6D:
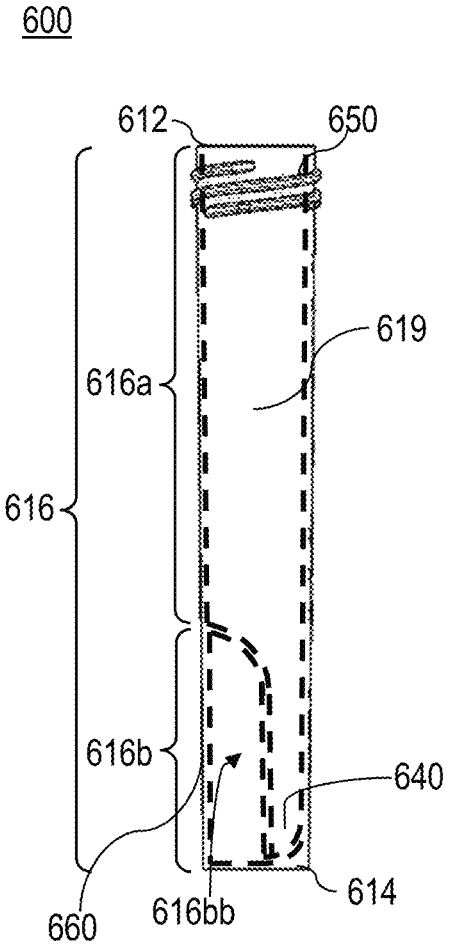
FIGS. 6D and 6E are schematic illustrations of a test tube including a narrowed region at its closed end, and further including a second annular body surrounding the narrowed region, according to some embodiments of the invention.
Figure 6E:
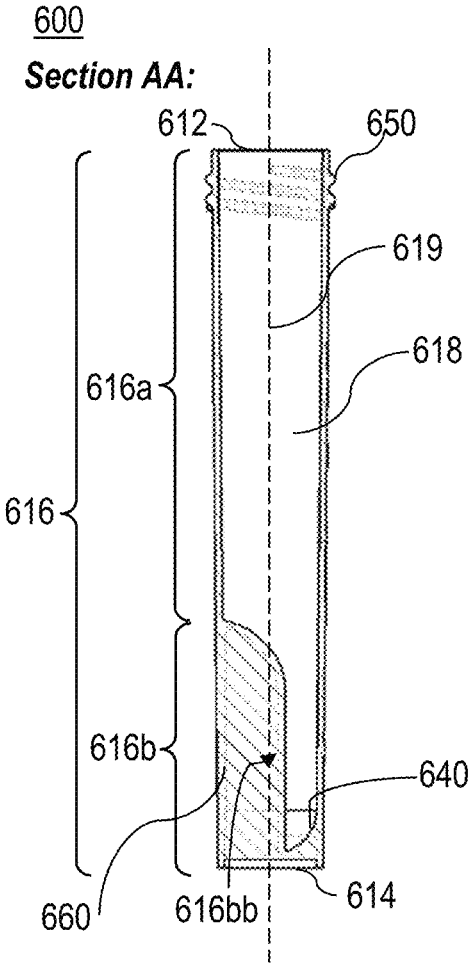

Reference is now made to FIGS. 6D and 6E, which are schematic illustrations of a test tube 600 including a narrowed region 640 at its closed end 614, and further including a second annular body 660 surrounding narrowed region 640, according to some embodiments of the invention.

FIG. 6D shows a schematic side view of test tube 600. FIG. 6E shows a schematic longitudinal section view A-A of test tube 600.

In some embodiments, test tube 600 may include a second annular body 660 that surrounds second longitudinal portion 616*b* of longitudinal surface 616 of annular body 610. In some embodiments, second annular body 660 may have a generally or substantially cylindrical shape with a circular (or substantially circular) cross-section. In some embodiments, second annular body 660 may be connected at its first or proximal end to a second or distal end of first longitudinal portion 616*a* of annular body 610. In some embodiments, second annular body 620 may be formed as an integral part of first longitudinal portion 616*a* of annular body 610.

In some embodiments, test tube 600 may include an external thread 650 on longitudinal surface 616 of annular body 610 adjacent to open first end 612 thereof, wherein external thread 650 may mate with an internal thread of a cap (e.g., such as cap 190 described above with respect to FIGS. 1A and 1B). The cap may be screwed onto open first end 612 of annular body 610 to tightly close the open first end 612 of annular body 612.

In some embodiments, test tube 600 may include a marking indicative of a position of a narrowed region 640 within interior 618 of annular body 610 (e.g., such as marking 130 as described above with respect to FIG. 1G). In some embodiments, test tube 600 includes a marking indicating an identification label position, which is a position at which the identification label (e.g., a barcode label) may be attached (e.g., such as marking 140 described above with respect to FIG. 1F).

Some embodiments of the present invention provide a kit including test tube 600 and a cap (e.g., such as cap 190 described hereinabove). In some embodiments, the kit includes one or more test sticks (e.g., such as sticks 200 and 700 described hereinabove).

Some embodiments of the present invention provide a kit including test tube 600 and one or more test sticks (e.g., such as sticks 200 and 700 described hereinabove). In some embodiments, the kit includes a cap (e.g., such as cap 190 described hereinabove).

In the above description, an embodiment is an example or implementation of the invention. The various appearances of "one embodiment", "an embodiment", "certain embodiments" or "some embodiments" do not necessarily all refer to the same embodiments. Although various features of the invention can be described in the context of a single embodiment, the features can also be provided separately or in any suitable combination. Conversely, although the invention can be described herein in the context of separate embodiments for clarity, the invention can also be implemented in a single embodiment. Certain embodiments of the invention can include features from different embodiments disclosed above, and certain embodiments can incorporate elements from other embodiments disclosed above. The disclosure of elements of the invention in the context of a specific embodiment is not to be taken as limiting their use in the specific embodiment alone. Furthermore, it is to be understood that the invention can be carried out or practiced in various ways and that the invention can be implemented in certain embodiments other than the ones outlined in the description above.

The invention is not limited to those diagrams or to the corresponding descriptions. For example, flow need not move through each illustrated box or state, or in exactly the same order as illustrated and described. Meanings of technical and scientific terms used herein are to be commonly understood as by one of ordinary skill in the art to which the invention belongs, unless otherwise defined. While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

The invention claimed is:

1. A test tube comprising:

a first annular body having an open first or proximal end, a closed second or distal end, a longitudinal surface extending between the open first end and the closed second end and enveloping a hollow interior of the first annular body, and a central longitudinal axis;

wherein the longitudinal surface of the first annular body comprises:

a first longitudinal portion comprising the open first or proximal end of the first annular body and having a substantially circular cross-section in a central longitudinal direction of the first longitudinal portion;

a second longitudinal portion comprising:

a first longitudinal side having a substantially circular-arc cross-section in the central longitudinal direction of the first longitudinal portion; and a second longitudinal side being substantially flat and lying in a plane parallel to the central longitudinal direction of the first longitudinal portion, the closed second or distal end being positioned at the distal portion of the second longitudinal portion and being rounded; and a third longitudinal portion connecting the first longitudinal portion and the second longitudinal portion, the third longitudinal portion comprising:

a first longitudinal side having a substantially circular-arc cross-section in the central longitudinal direction of the first longitudinal portion and defined by a diameter, the diameter also defining the circular-arc cross-section in the central longitudinal direction of the first longitudinal portion of the first longitudinal side of the second longitudinal portion; and a second longitudinal side comprising a tapering section tapering in a longitudinal direction of the first annular body towards the closed second end of the first annular body, the tapering section comprising a first section with constant slope along its length and a second section curved inwardly towards the interior of the body.

2. The test tube of claim 1, wherein a slope of the inwardly curved section of the second longitudinal side of the third longitudinal portion varies along at least a portion of its length.

3. The test tube of claim 1, wherein the tapering section of the third longitudinal portion of the longitudinal surface comprises one or more substantially planar regions.

4. The test tube of claim 1, wherein the second longitudinal side of the second longitudinal portion of the longitudinal surface comprises a distal planar region that is connected to the closed second end of the first annular body.

5. The test tube of claim 1, wherein the second longitudinal side of the second longitudinal portion of the longitudinal surface forms, with the first longitudinal side of the second longitudinal portion of the longitudinal surface, a narrowed region within the interior of the first annular body adjacent to the closed second end of the first annular body.

6. The test tube of claim 5, wherein the second longitudinal side of the second longitudinal portion of the longitudinal surface is shaped and sized such that the narrowed region tightly receives one or more testing portions of corresponding one or more test sticks.

7. The test tube of claim 5, wherein the second longitudinal portion receives one or more test sticks in a known position.

8. The test tube of claim 1, further comprising a second annular body surrounding the second longitudinal portion of the longitudinal surface of the first annular body.

9. The test tube of claim 8, wherein the second annular body is connected at its first or proximal end to a second or distal end of the first longitudinal portion of the longitudinal surface of the first annular body.

10. The test tube of claim 9, wherein the second annular body is formed as an integral part of the first annular body.

11. A kit comprising:

the test tube of claim 1; and a test tube cap structured to tightly close the open first or proximal end of the test tube.

12. A kit comprising:

the test tube of claim 1; and one or more test sticks.

13. The kit of claim 12, wherein each of the test sticks comprises a weakened portion along a length of the test stick.

14. The test tube of claim 1, wherein the length of the second longitudinal portion is between 20-40% of a total length of the first annular body.

15. The test tube of claim 1, wherein the second longitudinal side of the second longitudinal portion is offset towards the first longitudinal side of the second longitudinal portion.

16. The test tube of claim 1, wherein the second longitudinal side of the second longitudinal portion is offset towards the first longitudinal side of the second longitudinal portion by 5-10% of a maximal diameter of the first annular body.

* * * * *